US005855427A

United States Patent [19]

Lassovsky

[11] Patent Number: 5,855,427

[45] Date of Patent: Jan. 5, 1999

[54] LUMINAIRE

[76] Inventor: Leon A. Lassovsky, Castillo de Utera #1, Seville, Spain, 41013

[21] Appl. No.: 703,845

[22] Filed: Aug. 27, 1996

Related U.S. Application Data

[60] Provisional application No. 60/004,772, Oct. 4, 1995.

[51] Int. Cl.[6] ..... F21V 21/14

[52] U.S. Cl. ..... 362/283; 362/220; 362/285; 362/284; 362/324; 362/372; 362/418

[58] Field of Search ..... 362/217, 220, 362/277, 282, 283, 285, 297, 298, 301, 284, 319, 322, 324, 346, 364, 372, 418

[56] References Cited

U.S. PATENT DOCUMENTS

| | | | |
|---|---|---|---|
| 2,619,585 | 11/1952 | Peters | 362/322 |
| 4,007,365 | 2/1977 | Stempfle et al. | 362/283 |
| 4,872,098 | 10/1989 | Romano | 362/283 |
| 5,207,496 | 5/1993 | Stanuch et al. | 362/35 |
| 5,426,417 | 6/1995 | Stanuch | 362/35 |
| 5,564,815 | 10/1996 | Littman et al. | 362/220 |

*Primary Examiner*—Thomas M. Sember
*Attorney, Agent, or Firm*—Gifford, Krass, Groh, Sprinkle, Patmore, Anderson & Citkowski, P.C.

[57] ABSTRACT

A luminaire for a fluorescent bulb having a support unit for a fluorescent bulb which is movable to be adjustably positioned with respect to the opening to narrow or broaden the width of the beam of light emitted. The support unit has pairs of pivotable reflectors and adjustment mechanism for positioning the angle of the reflectors to reflect light in the desired manner. The adjustment mechanism includes pivotable mounts having gears wheels which are turned by a worm gear on an adjustment rod. The movable reflectors can be interchanged to present different surface contours and spectral coatings.

15 Claims, 4 Drawing Sheets

LUMINAIRE

This application claims the benefit of U.S. Provisional Application No. 60/004,772, filed Oct. 4, 1995.

I. Field of the Invention

This invention relates to a luminaire, and more particularly, to a luminaire having adjustable reflectors positionable to increase efficiency and energy conservation.

II. Background of the Invention

Luminaires or light fixtures for use with fluorescent bulbs have been in use for many years. Luminaires typically have rectangular box-like bodies which are adapted to be mounted in ceilings. The luminaire is generally provided with some type of reflectors positioned longitudinally behind or alongside of the fluorescent bulb to reflect light outwardly from the luminaire into the area desired to be lit.

Recently, energy conservation and efficiency of luminaires has been improved by the use of reflectors formed of specular material, such as silver or aluminum. These materials reflect light with greater precision than previous materials and permit the lighting engineer to control the manner in which the light is reflected.

State of the art luminaires are currently custom manufactured to meet luminosity criteria desired for the installation site. To ensure the installation of the most suitable lighting fixtures, on-site measurements are taken, appropriate reflector designs are chosen, and the reflector material, usually in the form of sheet metal, is bent or molded into reflectors composed of many precise angles at which the light is to be reflected without causing unsightly overlap with the resultant beams of light. Such a procedure is time consuming and expensive. If the measurements are not carefully taken, it may be necessary to rebuild the luminaire or to make other adjustments which lead to diminution of the efficiency of the energy utilized.

It is also known to provide a luminaire with movable reflectors which may be positioned to change the physical dimensions of the light column produced by the light fixture, such as disclosed in U.S. Pat. No. 3,099,403 to Strawick.

It is also known as disclosed in U.S. Pat. No. 3,166,253 to provide a luminaire having a plurality of movable slats or reflectors positioned outwardly from fluorescent bulbs. The reflectors are movable together like a Venetian blind to simulate natural light coming through a Venetian blind.

However, none of the presently known devices provide the necessary adjustments to increase energy efficiency and energy conservation.

Accordingly, it is desirable to provide a luminaire which has adjustable and interchangeable reflectors which are easily positionable to provide maximum efficiency for a full range of applications or adjusted for a different application.

SUMMARY OF THE INVENTION

Thus disclosed is a novel luminaire having an outer body and a support structure for mounting of both fixed and pivotable reflectors. The support structure is positionable within the body to widen or narrow the width of the beam of light emitted from the luminaire. Additionally, the support structure can be angled within the body to provide an asymmetrical light beam if desired. The movable reflectors are mounted to pivotal mounts connected to positioning rods to provide precise adjustment of the directional light reflectivity. The reflectors are mounted to brackets to permit ready substitution of reflectors having different reflection characteristics. Alteratively, the luminaire can be provided with a two-sided or three-sided reflector. Each of the sides having different reflective characteristics. The reflectors are pivotable so that the side with the desired characteristics can be chosen.

A more complete understanding of this invention may be obtained from the following detailed description as well as taken with the accompanying drawings.

DETAILED DESCRIPTION OF THE PREFERRED EMBODIMENTS

Figure 1:
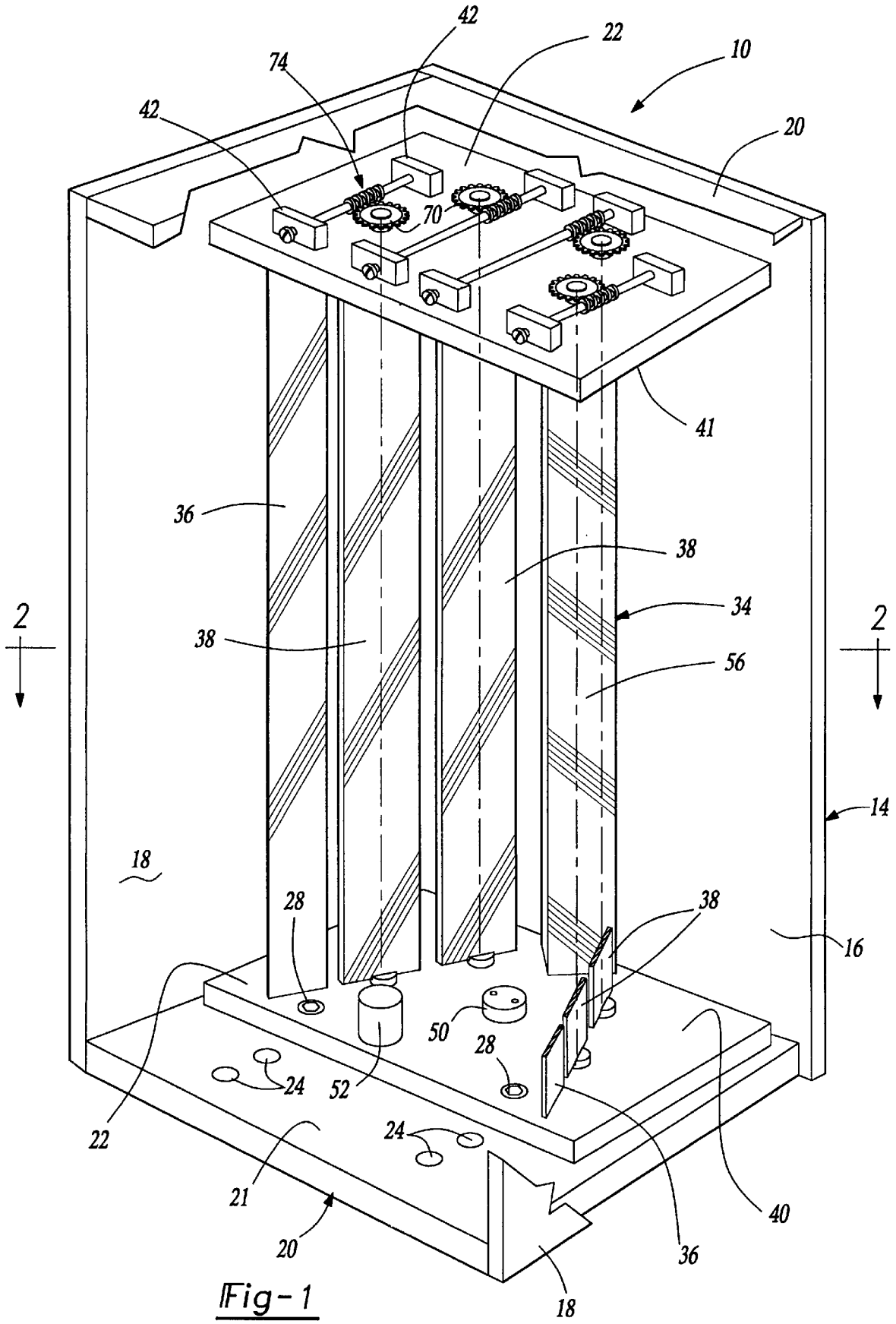
FIG. 1 is a partially exploded perspective view of a luminaire according to the invention.
Figure 2:
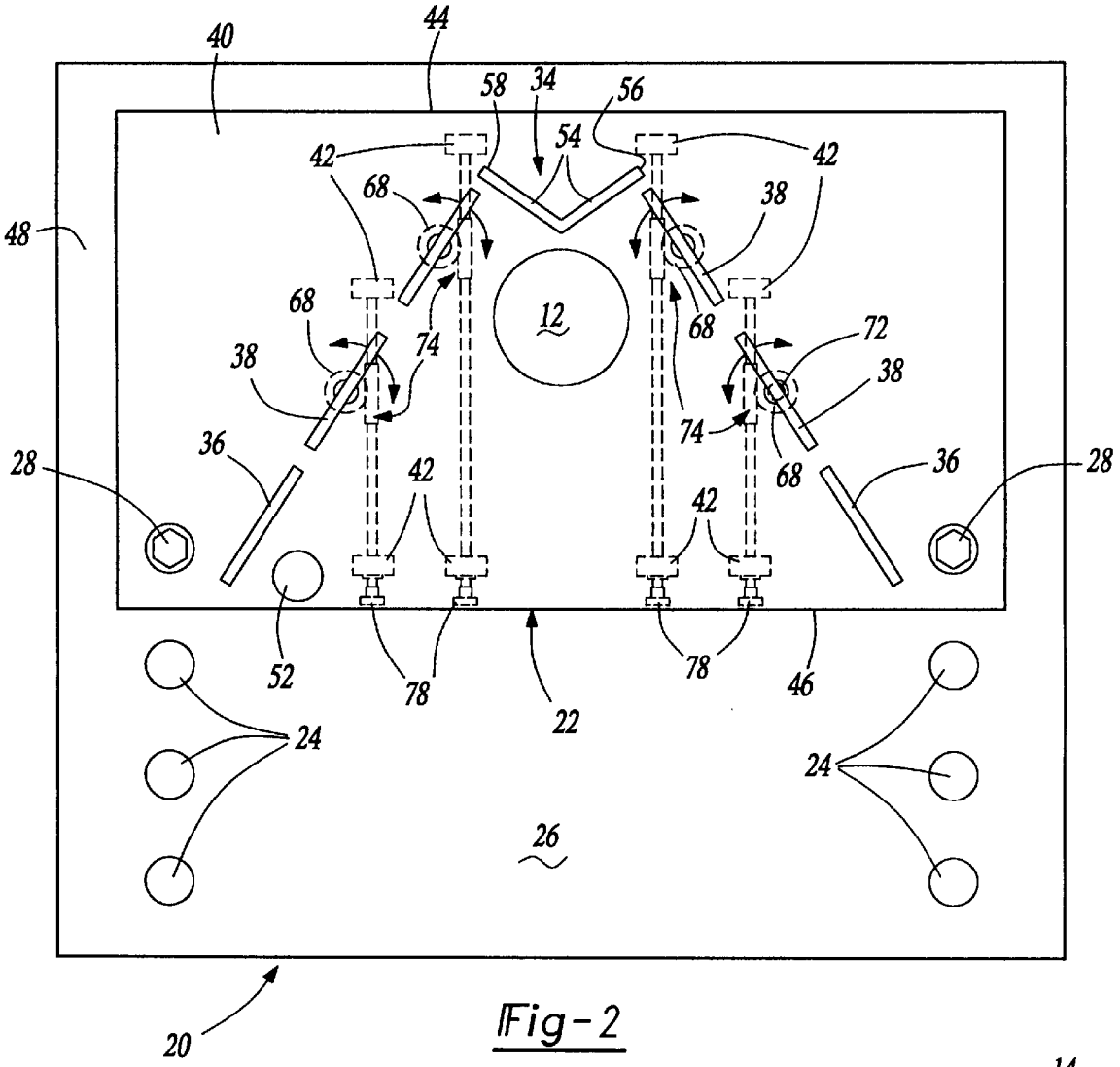
FIG. 2 is a cross-sectional view of the luminaire taken along lines 2—2 of FIG. 1.

A luminaire 10 for a fluorescent light 12 according to the invention is best shown in FIGS. 1 and 2. The luminaire 10 is suitable for mounting in a ceiling suspended or recessed in a ceiling or wall (not shown). The luminaire includes a rectangular box-like body 14 having an opening for accepting a conventional lite (not shown). The body 14 has a top 16 and a pair of sides 18 which extend between a pair of ends 20. The body 14 is formed of a rigid, heat resistant material such as aluminum.

A support unit 22 is adjustably mounted to inner sides 26 of each end 20 of the body 14. Two vertically aligned rows of threaded apertures 24 are formed in the ends 20 for receiving bolts 28 for mounting the support unit 22 to the body 14.

Figure 3A:
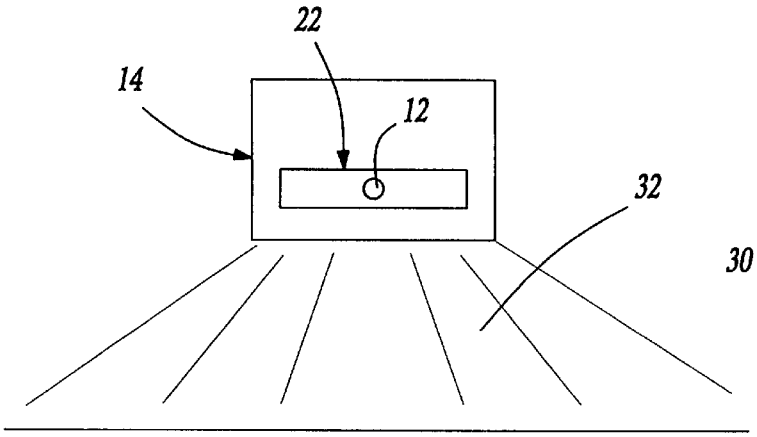
FIG. 3*a* is a schematic end view of the luminaire with the support unit in a lowered position producing a wide distribution beam of light.
Figure 3B:
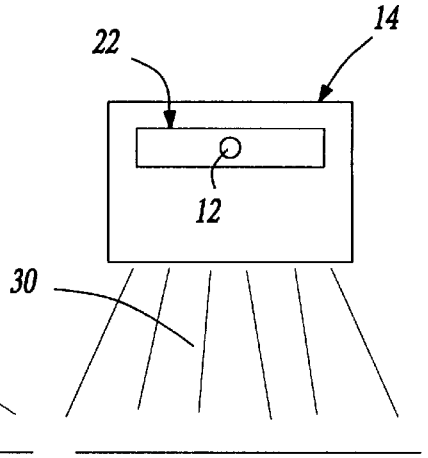
FIG. 3*b* is a schematic view of the luminaire with the support unit in a raised position producing a narrow distribution beam of light.

As discussed more fully below, and shown in FIGS. 3*a* and 3*b*, the rows of apertures 24 permit mounting of the support unit 22 in a range of positions to vary the width of the projected beam of light. In a raised position shown in FIG. 3*b*, the support unit 22 projects a narrow width beam 30 of light. In a lower position, shown in FIG. 3*a*, the support unit 22 projects a wide width beam 32 of light. The support unit 22 may be angled with respect to the opening 21 for producing an asymmetric beam of light.

As shown in FIG. 2, the support unit 22 includes a pair of end pieces 40, 41 supporting the fluorescent bulb 12, a fixed center reflector 34, a pair of fixed side reflectors 36 and two pairs of movable reflectors 38. The end pieces 40, 41 are generally rectangular in shape having an inner edge 44, outer edge 46, and a pair of side edges 48. As discussed more fully below, the end piece 40 is spaced apart from the inner surface 26 of the housing 14 by spacer brackets 42. The ends of the fluorescent bulb 12 are received in sockets 50 mounted on each end piece 40, 41. The bulb 12 thus extends along a longitudinal axis within the body 14 and support member 22. An electronic ballast 52 is also mounted on the end piece 40.

The fixed center reflector 34 is mounted by brackets to each end piece 40, 41. The center reflector 34 has two lateral sides 54 extending in a "V" from a corner 56. The corner 56 of the "V" is mounted between the socket 50 and the inner edge 44 of the end pieces. The sides 54 of the center reflector 34 extend parallel with the longitudinal axis of the fluorescent bulb 12 to reflect light through the opening 21.

The fixed side reflectors 36 are mounted on either side of the bulb 12 adjacent the outer edge 48 of the end pieces 40, 41. In the preferred embodiment, the fixed reflectors 36 extend along a plane which extends parallel to the longitudinal axis of the fluorescent bulb 12 and intersects the outer edge 58 of each side 54 of the center reflector. The fixed reflectors 36 are made of suitable rigid material and are coated to reflect light. The reflectors 34, 36 may be provided with any of a variety of coatings or materials to provide either spectral reflection or diffuse reflection. For instance, silver coating will provide a reflection with a minimal diffuse reflection, while a white enamel coating will provide a relatively low spectral reflection with a relatively great diffuse reflection.

As best shown in FIGS. 1, 2, 4 and 4*a*, the movable reflectors 38 are mounted to the end pieces by an adjustment mechanism including mounting brackets 42 and an adjustment rod 74. The mount 62 has a shaft 66 extending from a flange 68 for mounting the movable reflector 38. The shaft 66 is positioned through an aperture 72 in the end piece with the flange 68 extending outwardly from the inner surface of the end piece. A gear wheel 70 is mounted on an opposite end of the rod 74 extending into the space formed by the spacer bracket 42 between the end piece 40 and the body 14.

Figure 4:
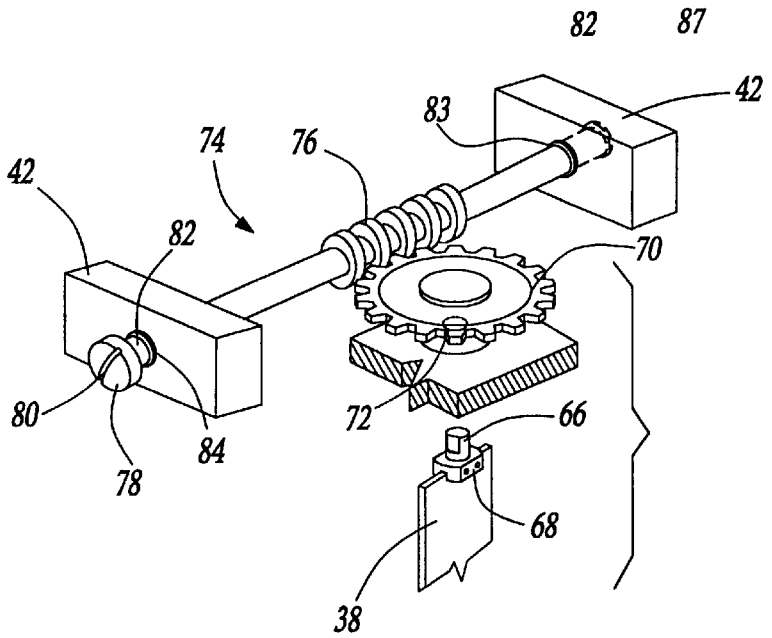
FIG. 4 is a perspective view of an adjustment mechanism for the movable reflectors in accordance with the invention.

As best shown in FIG. 4, an adjustment rod 74 having a worm gear 76 is mounted in meshing engagement with each gear wheel 70 by the pair of spacer brackets 42. Each adjustment rod 74 has an outer end having a head portion 78 having a slot 80 for accepting a blade of a screwdriver for rotating the rod 74. The outer surface may be grooved or knurled to facilitate rotation by hand. The worm gear 76 is positioned between a pair of cylindrical portions 82 which are received in an aperture 83 of each of the respective spacer brackets 42. An annular flange or stop 84 is formed on the rod to abut each bracket 42 to position the head portion 78 of the rod near the outer edge 46 of the end piece and position the worm gear 76 in engagement with the gear 70.

Figure 5:
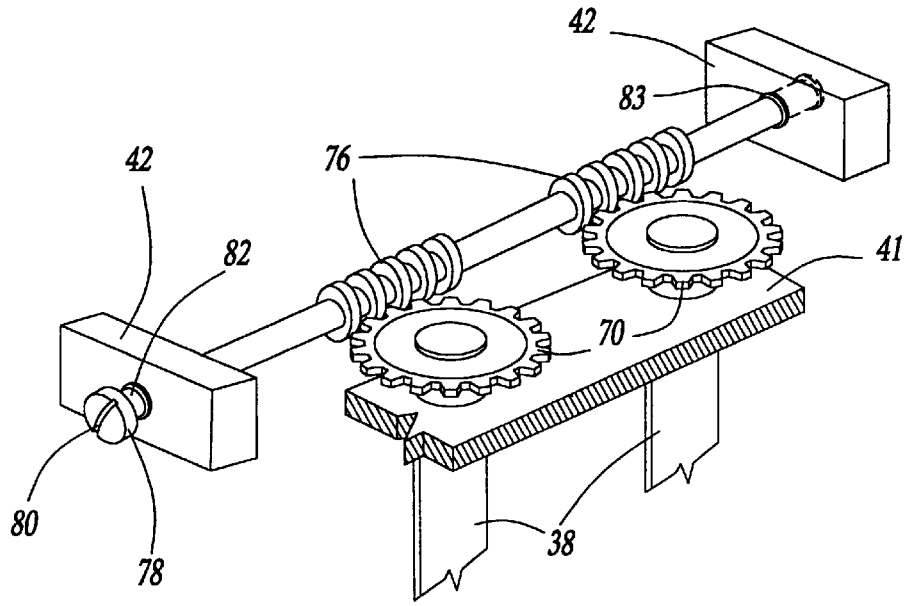
FIG. 5 is a first alternative embodiment of an adjustment mechanism for the movable reflector.

A first alternative embodiment of the adjustment mechanism is shown in FIG. 5. A rod 86 is formed with a pair of worm gears 76 to engage a pair of gear wheels 70 to adjustment of a pair of reflectors simultaneously.

Figure 6:
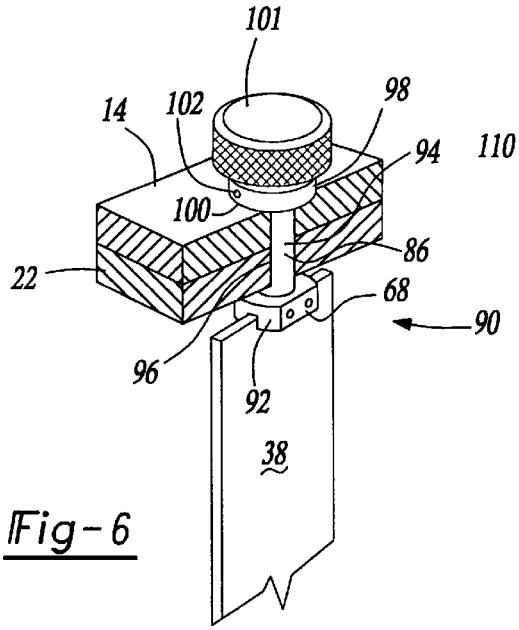
FIG. 6 is a perspective view of a second alternative adjustment assembly for the reflectors.

A second preferred embodiment is shown in FIG. 6, in which the end pieces of the support unit are mounted directly to the body without brackets 42. The reflectors 38 are pivotally mounted by a mount 90 which has a flange 68 extending from a disk 92 mounted to a shaft 94 which is formed to extend through the bore 96 which is formed through both the support unit 22 and the body 14. The end of the shaft 86 may be provided with a slot 80 as above or knurled to accept a knob 101. A disk 98 having a collar 100 and set screw 102 is mounted to secure the shaft 86 in position in the bore 96.

Figure 4A:
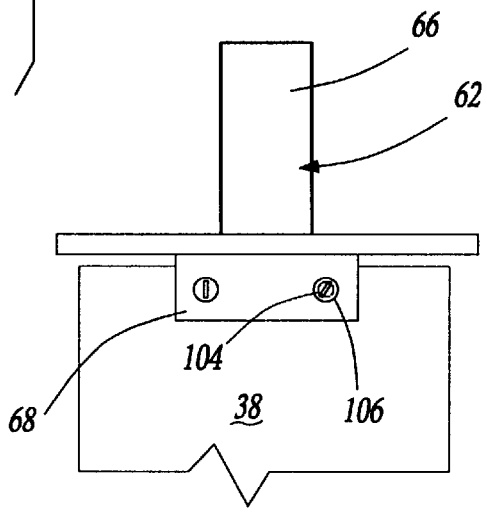
FIG. 4*a* is a partial side view of a mounting mechanism and a reflector.
Figure 7:
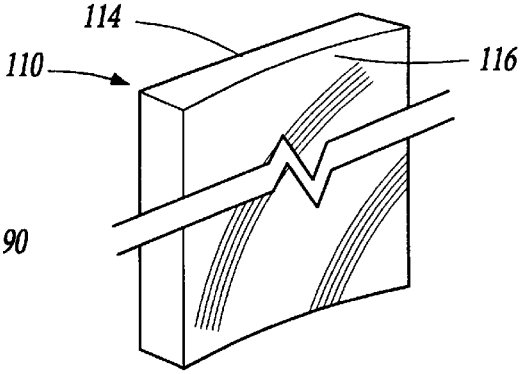
FIG. 7 is a perspective view of a two-sided reflector in accordance with the invention.
Figure 8:
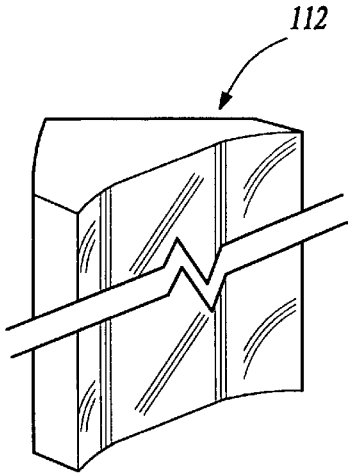
FIG. 8 is a perspective view of a three-sided reflector in accordance with the invention.

As shown in FIG. 4*a*, each rotating reflector 38 is rectangular and formed of a rigid material, such as aluminum or fiberglass. It is advantageous to proportion the width of the reflector to range between the diameter and circumference of the lamp, for instance, between ½" and 4.5". The length of the reflector 38 is approximately equal to the length of the fluorescent bulb 12. This length can exceed 70 inches in length. At least one hole 104 is formed at each end of the reflector 38 for receiving a screw 106 for attachment to the flange 68 of the mount. The reflector is shown in FIG. 4 with a flat surface. However, other surface shapes, such as concave or convex, can be used to provide the desired optics. As shown in FIGS. 7 and 8, a two surface reflector 110 or a three surface reflector 112 may be used. The two surface reflector 110 has a flat surface 114 and a concave surface 116. However, any other shape can be provided. The surfaces may have the same shape with different coatings. The two surface reflector 110 allows the user the option of rotating the reflector 110 from flat surface 114 to a concave surface 116 according to the illumination criteria used.

Figure 9A:
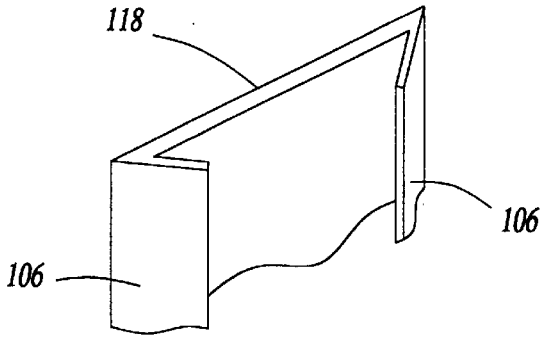
FIG. 9*a* is a perspective view of a reflector having a flat reflective surface.
Figure 9B:
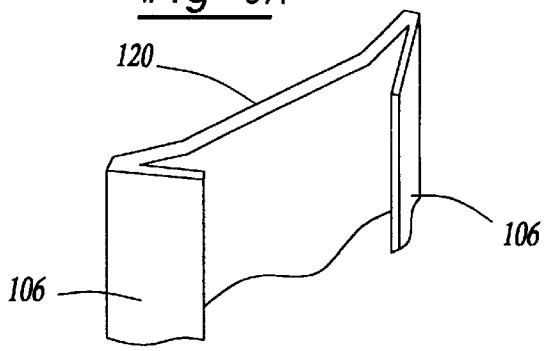
FIG. 9*b* is a perspective view of a reflector having a concave reflective surface.
Figure 9C:
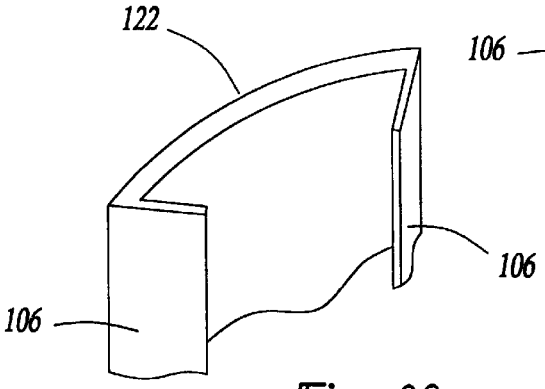
FIG. 9*c* is a perspective view of a reflector having a convex reflective surface.

As shown in FIGS. 8, 9*a*, 9*b*, and 9*c*, the three surface reflector 112 can be produced by combining a flat surface reflector 118 as shown in FIG. 9*a*, a concave surface reflector 120 as shown in FIG. 9*b*, together with a convex surface reflector 122 as shown in FIG. 9*c*. The reflectors are joined by fastening angled flanges 106 together.

Although shown with two pairs of reflectors 38, three pairs or more may be provided. The spacing between the reflectors 38 permits effective flow of cooling air to flow through the luminaire to cool the fixture.

While there have been described what are present to be the preferred embodiments of the invention, it will be understood that various modifications may be made therein and the invention is intended to cover in the independent claims all such modifications as fall within the true spirit and scope of the invention.

I claim:

1. A luminaire for a fluorescent light bulb for emitting a beam of light comprising:

an elongated body having a top and a pair of side walls defining an opening for permitting the beam of light from said light bulb to be emitted, said body having a first end and a second end, each of said ends including a plurality of vertically spaced attachment points;

a lamp support unit having a first end and a second end, said lamp support unit mounted within said body between said opening and said top such that said first end of said lamp support unit is adjacent said first end of said body and said second end of said lamp support unit is adjacent said second end of said body, each of said ends including at least one attachment member configured for engaging one of said plurality of attachment points such that each of said ends of said lamp support unit are independently, vertically adjustable in a linear direction so as to adjust a distance between said end or said lamp support unit and said opening, said support unit having means for mounting said light bulb;

whereby the width of the beam of light emitted from said opening in said elongated body is determined by the distance between said opening and said light bulb.

2. The luminaire of claim 1, wherein said support unit further comprises at least one reflector mounted to said support unit to pivot with respect to said support unit about a longitudinal axis of said reflector.

3. The luminaire of claim 2 further comprising means for pivotally adjusting said at least one reflector.

4. The luminaire of claim 2, further comprising means for detachably mounting said reflector to said support unit.

5. The luminaire of claim 2, wherein each of said at least one reflector further comprises a pair of opposed longitudinal reflective surfaces.

6. The luminaire of claim 1, further comprising a fixed reflector mounted adjacent said light bulb.

7. A luminaire for a fluorescent light bulb for emitting a beam of light, said luminaire comprising:

an elongated body having a top, a first and second side and a first and second end interconnecting said sides, and defining an opening for permitting the beam of light from said light bulb to be emitted, said sides each having a lower edge, each of said ends including a plurality of vertically spaced attachment points disposed along a central plane extending normal to said top;

a lamp support unit having a first end and a second end, said lamp support unit supported within said body such that said first end of said lamp support unit is adjacent said first end of said body and said second end of said lamp support unit is adjacent said second end of said body, each of said ends of said lamp support unit including at least one attachment member configured for engaging one of said plurality of attachment points such each of said ends of said lamp support unit are independently, vertically adjustable in a linear direction along said central plane, so as to adjust a distance between said end of said lamp support unit and said opening.

8. The luminaire of claim 7, further comprising a fixed reflector mounted adjacent said light bulb.

9. The luminaire of claim 7, wherein said lamp support unit is pivotally adjustable within said body between said top and said lower edges about a pivot axis in said central plane.

10. The luminaire of claim 7, wherein said support unit further comprises at least one reflector mounted to said support unit to pivot with respect to said support unit about a longitudinal axis of said reflector.

11. The luminaire of claim 10, further comprising means for detachably mounting said reflector to said support unit.

12. The luminaire of claim 10, wherein each of said at least one reflector further comprises a pair of opposed longitudinal reflective surfaces.

13. The luminaire of claim 10 further comprising means for pivotally adjusting said at least one reflector.

14. The luminaire of claim 13, wherein said means for pivotally adjusting comprises a gear wheel mounted to said reflector and a rod having a worm gear.

15. The luminaire of claim 13, wherein said means for pivotally adjusting comprises a knob mounted to a shaft mounted to one of said at least one reflector.

* * * * *